US006736219B1

(12) United States Patent
White

(10) Patent No.: US 6,736,219 B1
(45) Date of Patent: May 18, 2004

(54) UNDERGROUND HORIZONTAL BORING APPARATUS

(76) Inventor: William A. White, 6137 W. 231st, Bucyrus, KS (US) 66013

( * ) Notice: Subject to any disclaimer, the term of this patent is extended or adjusted under 35 U.S.C. 154(b) by 0 days.

(21) Appl. No.: 10/315,332

(22) Filed: Dec. 10, 2002

(51) Int. Cl.[7] ..... B23Q 5/22; E21B 19/16; E21B 19/14

(52) U.S. Cl. ..... 173/152; 173/32; 173/4; 175/52

(58) Field of Search ..... 173/32, 34, 35, 173/36, 37, 152, 159, 4, 213; 175/122, 162, 220, 52

(56) References Cited

U.S. PATENT DOCUMENTS

| | | | | | |
|---|---|---|---|---|---|
| 2,165,666 | A | * | 7/1939 | Tilly | 175/122 |
| 2,695,775 | A | * | 11/1954 | Marcerou | 175/108 |
| 2,819,042 | A | * | 1/1958 | Feucht | 173/36 |
| 3,107,741 | A | * | 10/1963 | Adams et al. | 175/122 |
| 3,150,723 | A | * | 9/1964 | Hale | 173/37 |
| 3,232,360 | A | * | 2/1966 | Dickinson | 175/62 |
| 3,486,571 | A | * | 12/1969 | Silverman | 175/5 |
| 3,565,187 | A | * | 2/1971 | Nils Gunnar Jonsson et al. | 173/152 |
| 3,587,755 | A | * | 6/1971 | Slusher | 173/159 |
| 3,886,999 | A | * | 6/1975 | Appleman | 173/159 |
| 3,902,385 | A | * | 9/1975 | Haby | 81/57.34 |
| 3,910,358 | A | | 10/1975 | Martinek | |
| 3,912,024 | A | | 10/1975 | Richmond et al. | |
| 3,938,597 | A | * | 2/1976 | Richmond et al. | 175/24 |
| 4,042,043 | A | | 8/1977 | Appleman | |
| 4,042,047 | A | | 8/1977 | Dively et al. | |
| 4,417,628 | A | | 11/1983 | Gessner | |
| 4,553,612 | A | | 11/1985 | Durham | |
| 4,591,007 | A | * | 5/1986 | Shaginian et al. | 175/85 |
| 4,953,638 | A | * | 9/1990 | Dunn | 175/61 |
| 4,955,757 | A | | 9/1990 | Balling | |
| 5,125,460 | A | * | 6/1992 | Behrens | 173/184 |
| 5,231,899 | A | * | 8/1993 | Lee | 81/57.16 |
| 5,803,189 | A | * | 9/1998 | Geldner | 175/113 |
| 6,343,663 | B1 | | 2/2002 | Hill et al. | |

* cited by examiner

*Primary Examiner*—Rinaldi I. Rada
*Assistant Examiner*—Paul R Durand
(74) *Attorney, Agent, or Firm*—Dale J. Ream

(57) ABSTRACT

An underground horizontal boring apparatus includes a framework having a pair of guide tracks and a carriage connected to the framework for movement along the tracks. The apparatus includes a mechanism for moving the carriage in forward or backward directions along the guide tracks. A drill assembly is mounted to the carriage having a drill motor for rotation of a drill rod releasably coupled thereto. A clamp assembly is mounted to one end of the framework and includes a clamp for selectively gripping the drill rod so as to rotatably release the drill rod from the drill motor when the drill motor is operated in a reverse direction. Upon release, the carriage may be moved to a start position, another drill rod may be attached to the drill motor and first rod, and boring resumed.

2 Claims, 4 Drawing Sheets

UNDERGROUND HORIZONTAL BORING APPARATUS

BACKGROUND OF THE INVENTION

This invention relates generally to earth boring equipment and, more particularly, to an underground horizontal boring apparatus for efficiently boring through the ground under a roadway and for pulling pipe through the bore.

Trenchless digging of pipe channels saves time and money in that no there are no trenches to fill or landscape following installation of pipes. While large horizontal boring equipment has been proposed in the art, these devices are not efficient for the completion of typical plumbing or other general contracting jobs.

Therefore, it is desirable to have an underground horizontal ground boring apparatus that may be positioned and operated in a small pit by a single operator. Further, it is desirable to have a boring apparatus having a plurality of drill rods that may be sequentially coupled to the apparatus for boring an elongate horizontal underground channel. In addition, it is desirable to have an apparatus that can sequentially pull pipe back through an underground bore by sequentially uncoupling drill rods from the apparatus.

SUMMARY OF THE INVENTION

An underground horizontal boring apparatus according to the present invention includes a framework having a pair of elongate guide tracks extending longitudinally between opposed front and rear walls. The boring apparatus further includes a carriage mounted to the framework for frontward and backward movement along the guide tracks. A power-driven threaded shaft extends between the front and rear walls and is operatively connected to the carriage. Accordingly, rotation of the shaft causes the carriage to be moved in corresponding frontward or backward directions. A drill assembly is mounted atop the carriage, the drill assembly including a drill motor to which a drill rod may be coupled for rotation. Therefore, the drill rod may be utilized to bore horizontally through the ground as the drill rod is rotated and as the carriage is moved in a forward direction.

A clamp assembly is mounted atop the front end wall of the framework, the clamp assembly having at least a first clamp. When the carriage is adjacent the front end wall, the first clamp may be operated to grip and hold stationary the drill rod. The drill rod may then be released from the drill motor when the drill motor is reversed. The carriage may then be moved adjacent the rear end wall, one end of another drill rod may be coupled to the drill motor with an opposed end being coupled to the first drill rod. In another way, operation of the drill motor in a reverse direction while the first clamp is engaged uncouples the first drill rod. The carriage may be returned to the rear end wall and another drill rod attached to the drill motor for extension between the motor and an end of a preceding drill rod. This process may be repeated until the sequentially added drill rods bore completely through the ground to an intended target. Following full extension, a pipe or pipe segment may be coupled to a free end of the first drill rod for being pulled back through the underground bore. Drill rods are sequentially removed as the drill motor is operated in a reverse direction so as to pull the pipe through the bore.

A general object of this invention is to provide a boring apparatus for trenchless digging of an underground horizontal bore.

Another object of this invention is to provide a boring apparatus, as aforesaid, which may be positioned and operated in a small pit by a single operator.

Still another object of this invention is to provide a boring apparatus, as aforesaid, which carries a plurality of separate drill rods for convenient coupling to a drill assembly.

Yet another object of this invention is to provide a boring apparatus, as aforesaid, in which multiple drill rods may be sequentially coupled and uncoupled quickly and easily using a clamping mechanism.

A further object of this invention is to provide a boring apparatus, as aforesaid, in which the driving, drilling, and clamping mechanisms may be operated using a control panel.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
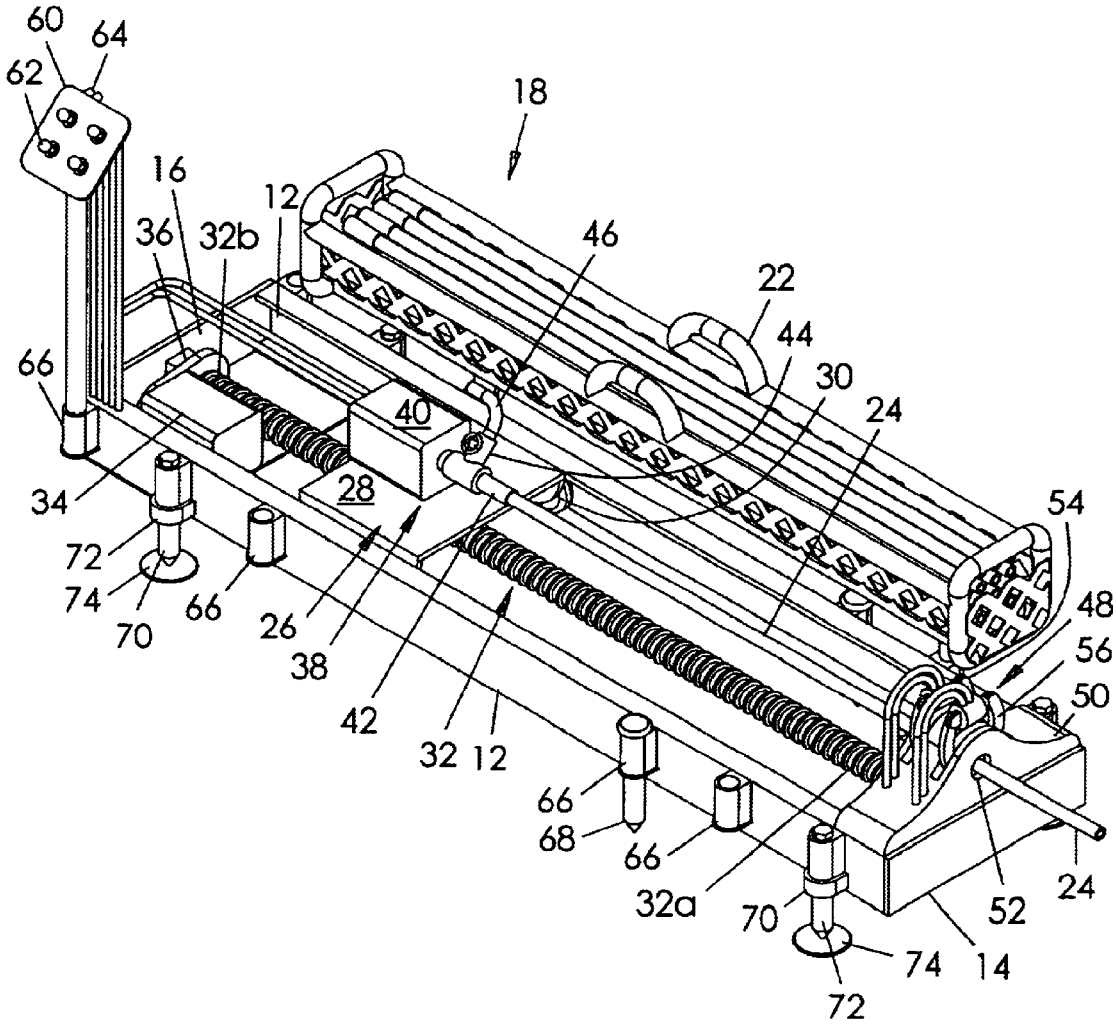
FIG. 1 is a perspective view of an underground horizontal boring apparatus according to one embodiment of the present invention.
Figure 2A:
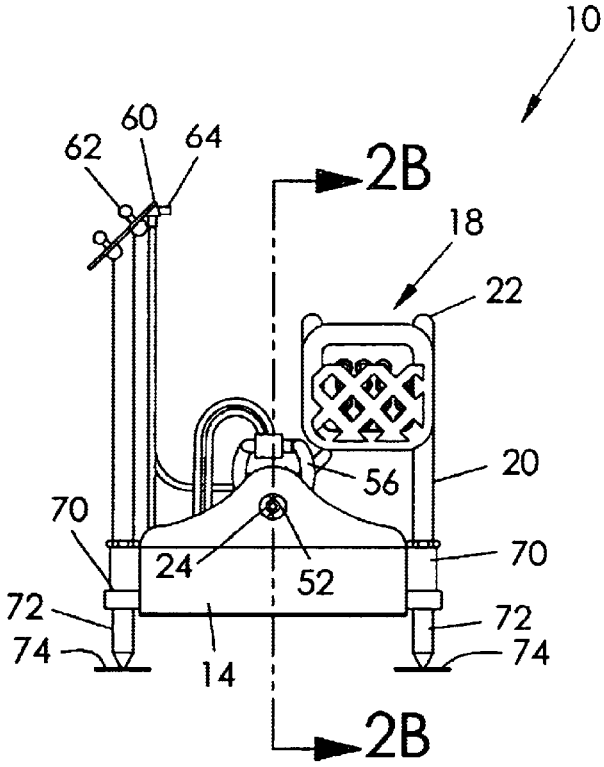
FIG. 2A is a front end view of the boring apparatus as in FIG. 1.
Figure 2B:
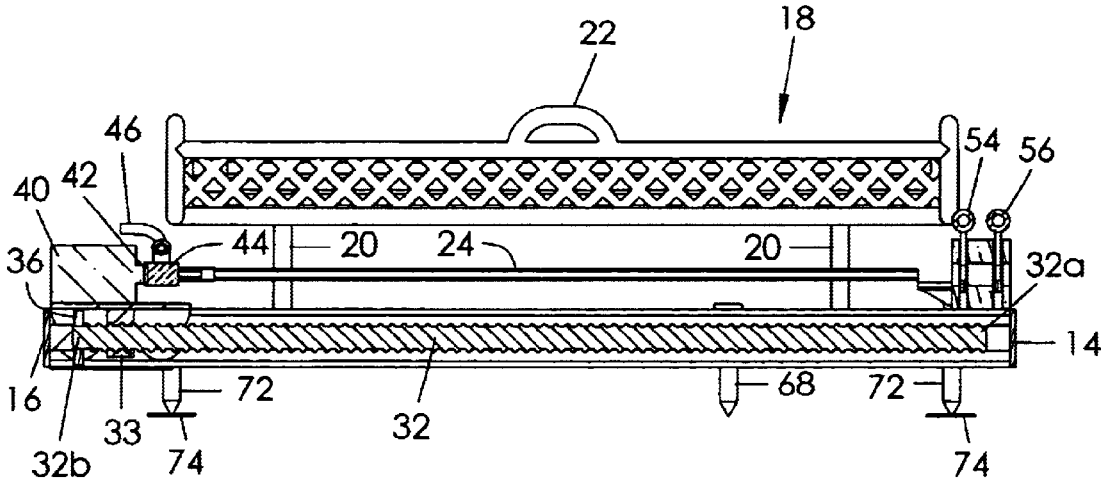
FIG. 2B is a sectional view taken along line 2B—2B of FIG. 2A.

An underground horizontal boring apparatus according to the present invention will now be described with reference to FIGS. 1 through 4 of the accompanying drawings. A boring apparatus 10 according to one embodiment is shown in FIGS. 1 through 2B and includes a framework having a pair of elongate guide tracks 12 extending parallel to one another between opposed front 14 and rear 16 end walls (FIG. 1). Preferably, each guide track 12 presents a generally C-shaped configuration although an I-beam or other similar configuration may be employed.

The boring apparatus 10 includes a bin 18 having an elongate bottom with side and end walls extending upwardly from the bottom. The bin 18 is capable of holding a plurality of drill rods 24 (FIG. 1). In addition, the bin 18 includes at least a pair of legs 20 that may be mounted to corresponding attachment flanges 66 on the apparatus framework. Thus, the bin 18 may be mounted at a selected location relative to the framework and may be removed or repositioned as desired by a user. The bin 18 includes a pair of handles 22 such that the bin 18 may be easily removed, repositioned, or carried to another location. Being able to hold a plurality of drill rods 24 in close proximity to the rest of the apparatus enhances the speed and efficiency of the overall apparatus, as will become apparent in the description below.

The boring apparatus 10 further includes a carriage 26 mounted to the framework for movement along the guide tracks 12 (FIG. 1). The carriage 26 includes a planar platform 28 with side walls depending therefrom and having wheels 30 pivotally mounted to the side walls for movement along the guide tracks 12. It would also be suitable for the carriage to include rods with bushings for movement along the guide tracks 12 as an alternative to wheels. Therefore, the carriage 26 is capable of forward and backward movement along the guide tracks 12. A threaded shaft 32 preferably having an acme thread pattern, also referred to as a power screw, having first 32*a* and second 32*b* ends is rotatably mounted to the front 14 and rear 16 walls, respectively, of the framework and extends therebetween (FIG. 1). A thrust motor 34 is also mounted to the framework adjacent the rear wall 16 and is operatively connected to the shaft 32 with a gearbox 36 such that the speed of the shaft 32 may be controlled. Preferably, the thrust motor 34 is hydraulically operated, as to be further described below, although electrical power would also work. The shaft 32 is connected to the carriage 26 with a nut 33 or the like (FIG. 2B) such that rotation of the shaft causes forward or backward linear motion of the carriage.

Figure 4:
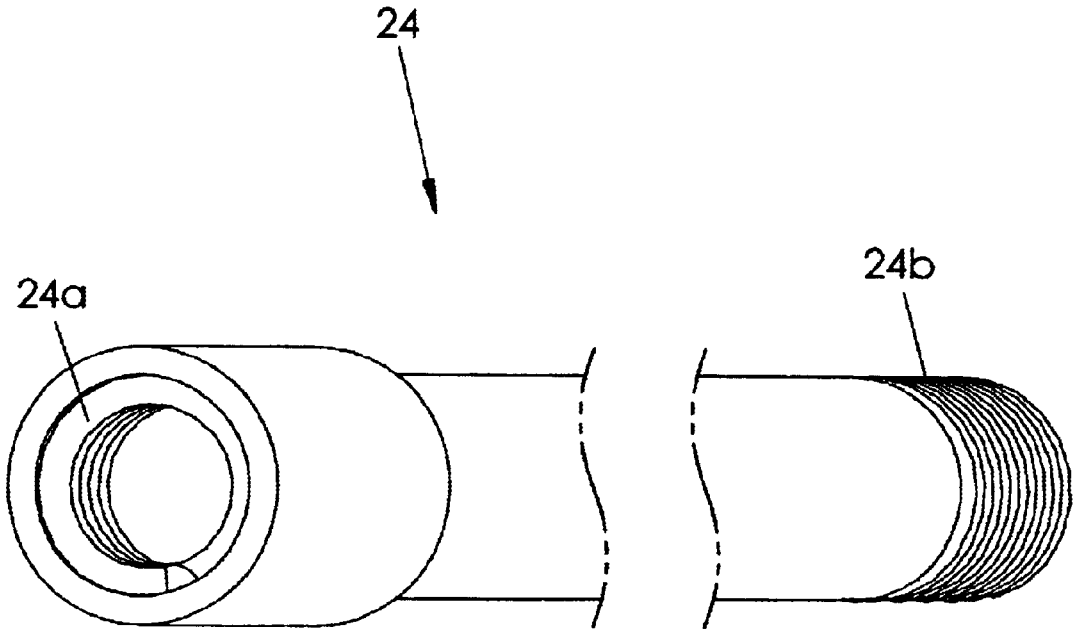
FIG. 4 is a perspective view of a drill rod according to the invention shown in FIG. 1.

A drill assembly 38 is mounted to the carriage 26 for movement therewith. More particularly, the drill assembly 38 includes a drill motor 40 positioned atop the carriage platform 28 and a drill rod coupling 42 for releasably connecting a drill rod 24 to the drill motor 40 (FIG. 1). A drill rod 24 includes a female threaded end 24*a* for being rotatably coupled to the drill rod coupling 42 and to a male end 24*b* of another drill rod (FIG. 4). The drill rod coupling 42 is situated on a front portion of the drill motor 40 such that a drill rod 24 connected thereto extends toward the front wall 14 of the framework. In addition, a valve assembly 44 is coupled to the drill rod coupling 42 and connected with a conduit 46 for fluid communication of water for cooling the drill rod 24 and to remove debris from the drill rod 24. It is understood that the valve assembly 44 maintains a fixed position and allows the drill motor 40 and drill rod coupling 42 to rotate therein, such as with bearings. Preferably, the drill assembly 38 is also hydraulically powered although electrical power would also be suitable.

Further, the boring apparatus 10 includes a clamping assembly 48 mounted to the framework at a front end thereof. More particularly, the clamping assembly 48 includes a housing 50 mounted atop the front wall 14 of the framework, the housing 50 defining a bore 52 therethrough for receiving a drill rod 24 therethrough. The clamping assembly 48 further includes first 54 and second 56 clamps positioned on the housing 50 adjacent one another for selectively gripping a drill rod 24. Operation of the clamps is subject to user controls and may be operated hydraulically as will be described in more detail later, although other electromechanical means may also be employed. For example, a drill rod 24 connected to the drill motor 40 may be gripped and held stationary by the first clamp 54 while the drill motor 40 is reversed such that the drill rod may be rotatably released/uncoupled from the drill motor 40. The pair of clamps enables two drill rods that are rotatably connected to one another to be gripped and manipulated separately, as will be described further below relative to usage of the apparatus 10.

The boring apparatus 10 includes a control panel 60 mounted to the framework, the control panel having multiple user control buttons 62 or the like (FIG. 1). The control panel 60 includes a hydraulic fluid coupling 64 that is suitable for connection to a conventional hydraulic fluid source such as is provided on a tractor or similar machinery. Separate conduits extend from the control panel 60 to the thrust motor 34, drill motor 40, and clamping assembly 48. In fact, dual conduits extend to each of the aforementioned components such that respective motors or clamps may be operated in selectively opposed directions. For example, the threaded shaft 32 may be operated in forward or backward directions, the drill rod 24 may be rotated in opposed directions, and the clamps 54, 56 may be activated or deactivated. It should be appreciated that the control panel 60 may be programmed to operate the apparatus 10 with only minimal user interaction. For example, the control panel 60 may be programmed such that the drill motor 40 automatically operates a drill rod 24 in a use direction while the carriage is automatically moved at a predetermined speed in a forward direction. The first clamp 54 may automatically grip the drill rod 24 when the carriage 26 has reached an end position adjacent the front wall 14. Then, the drill motor 40 may be automatically reversed while the first clamp 54 is still engaged so as to rotatably uncouple the drill rod 24 from the drill motor 40. Of course, each of these actions could instead be initiated by a specific user activation of respective control panel button 62.

A plurality of attachment flanges 66 are fixedly attached to outer surfaces of the framework guide tracks 12 (FIG. 1). Each attachment flange 66 includes a generally tubular configuration. A plurality of stakes 68 may be inserted through corresponding tubular attachment flanges 66 and urged into a ground surface for securing the framework at a predetermined position. Special threaded attachment flanges 70 are mounted to the guide tracks adjacent the front 14 and rear 16 walls for threadably receiving leveler stakes 72 therethrough. While similar to the stakes 68 described above, the leveler stakes 72 may be rotated a predetermined amount within corresponding threaded attachment flanges 70 so as to raise or lower the front or rear end of the framework relative to the ground surface. Of course, the leveler stakes 72 may be utilized both in the regular attachment flanges 66 as well as in the special threaded attachment flanges 70 although the framework is only height-adjustable when used in the threaded attachment flanges 70. A support pad 74 may be positioned between each leveler stake 72 and the ground such that the stake does not penetrate the ground. As described previously, the drill rod bin 18 includes legs 20 that may be inserted into correspondingly positioned attachment flanges 66 for releasably mounting the bin 18 to the framework.

In use, the boring apparatus 10 is positioned in a pit or trench for boring a horizontal distance, such as under a road, driveway, stream, or the like. The framework may be secured in place with the stakes 68. Preferably, the leveler stakes 72 are height adjusted such that the apparatus will bore slightly downhill. With the carriage 26 positioned adjacent the rear wall 16 of the framework, a first drill rod 24 may be coupled to the drill motor 40 for rotation thereby. Then as the threaded shaft 32 is rotated so as to move the carriage 26 in a forward direction, the first drill rod 24 extends through the clamping assembly housing bore 52. When the carriage 26 is adjacent the front wall 14, the clamping assembly 48 may be operated (via the control panel 60 or automatically) such that the first clamp 54 grips and holds stationary the first drill rod 24. The drill motor 40 may then be reversed such that the first drill rod 24 is uncoupled from the drill motor 40. The carriage 26 may then be returned to its start position adjacent the rear wall 16 by reversing the rotation of the threaded shaft 32. A first end of another drill rod may then be rotatably coupled to the drill motor 40 and an opposed end thereof may be coupled to the first drill rod 24. The threaded ends of the drill rods are shown in detail in FIG. 4. The carriage 26 may again be operated in a forward direction so as to again move the rods in a forward direction. It is understood that this process of increasing the overall length of the shaft by adding additional drill rods may be continued repeatedly for boring horizontally through the ground.

Once the drill rods have been extended completely under a respective obstacle, e.g. a road or driveway, the procedure may be reversed in order to pull a length of pipe back through the bore. The free end of the first drill rod may be coupled to a length of pipe for pulling the pipe through the bored channel. More particularly, the thrust motor 34 may be reversed so as to move the carriage 26 in a backward direction. When the carriage 26 is adjacent the rear wall 16 of the framework, the drill rod 24 that is coupled to the drill motor 40 must be removed. With the carriage in its rearward position, the junction between two drill rods is within the clamping assembly housing 50 such that the clamps 54, 56 may be used to selectively grip respective rods. Removal of the drill rod that is coupled to the drill motor 40 is accomplished by gripping and holding the second drill rod (i.e. the "second-in-line" rod) with the second clamp 56 while reversing the drill motor. This action rotatably uncouples the two drill rods from each other. Then, the first drill rod is held stationary by the first clamp for rotatably uncoupling the first drill rod from the drill motor 40. The first drill rod may then be manually removed and placed into the bin 18. The carriage 26 is moved adjacent the front wall 14 of the framework and coupled to the second drill rod and the procedure is repeated until all of the drill rods have been retrieved and a length of pipe has been pulled back through the bore.

Figure 3A:
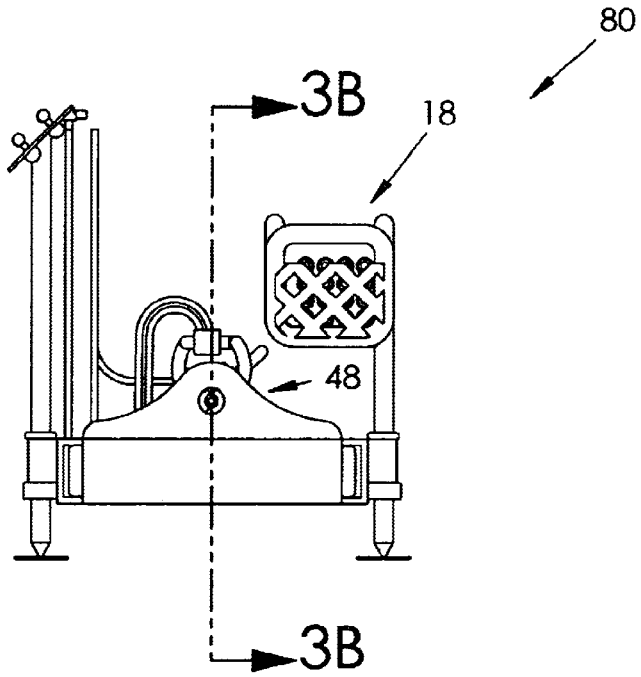
FIG. 3A is a front end view of an underground horizontal boring apparatus according to another embodiment of the present invention.
Figure 3B:
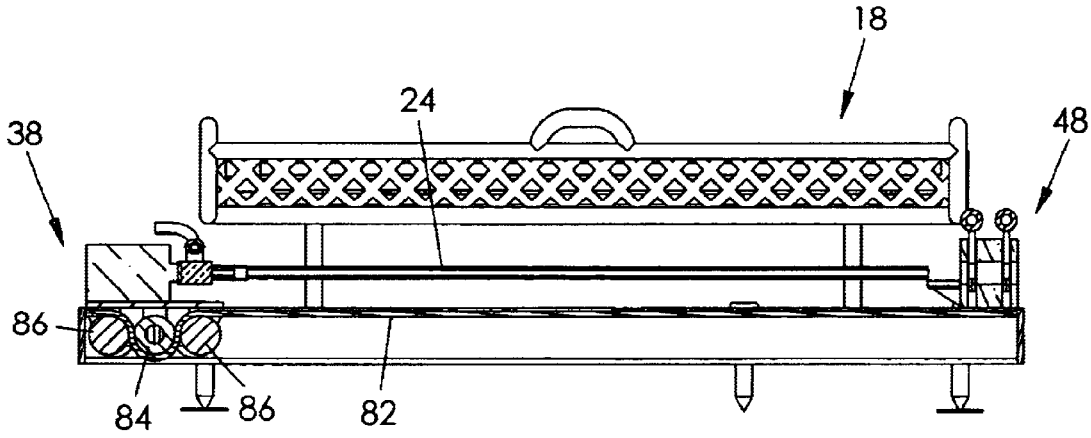
FIG. 3B is a sectional view taken along line 3B—3B of FIG. 3A.

An underground horizontal boring apparatus 80 according to another embodiment of the present invention is shown in FIGS. 3A and 3B and includes a construction substantially similar to the construction previously described except as specifically noted below. In this embodiment, a chain 82 extends between the front 14 and rear 16 walls of the framework instead of the threaded shaft 32 disclosed previously. A drive sprocket 84 is connected to the carriage 26 for movement therewith and is hydraulically connected to the thrust motor. A pair of tension sprockets 86 are also connected to the carriage 26 and are positioned on either side of the drive sprocket 84 so as to maintain the chain 82 in efficient engagement with the drive sprocket 84. In use, an operation of the drive sprocket 84 in engagement with the fixed chain 82 causes the carriage 26 to be moved in a forward or rearward direction. In a substantially similar manner, a rack and pinion gear combination (could be used rather than the chain and drive sprocket arrangement. As a further alternative, conventional hydraulic cylinders may be coupled to the carriage for selectively moving the carriage in forward or rearward directions.

In still another embodiment (not shown), a trio of pulleys may be rotatably mounted within the framework for pulling the carriage 26 in a forward or backward direction. As a central pulley is driven by the thrust motor, a cable pulls the carriage in a corresponding direction.

It should also be appreciated that the multiple drill rods that are coupled together sequentially may alternatively be coupled in a splined arrangement instead of a threaded arrangement. In a splined configuration, the ends of two rods mate together via complementary configurations (whether square, triangular, irregular, with teeth, etc.) rather than with threads. Accordingly, rods connected in this manner would not need to be held stationary with clamps in order to be uncoupled from one another as previously described.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An underground horizontal boring apparatus, comprising:

a framework having a pair of elongate guide tracks extending longitudinally between front and rear end walls;

a carriage connected to said framework for movement along said pair of guide tracks;

a bin mounted to said framework, said bin having an elongate bottom with side walls extending upwardly therefrom and defining an open top for holding a plurality of drill rods;

a threaded shaft having first and second ends rotatably mounted to said front and rear end walls, respectively, and extending therebetween;

means on said carriage for engaging said shaft;

a thrust motor mounted to said framework for rotating said shaft in first and second directions, a rotation of said shaft in a first direction causing said carriage engaging means to move said carriage in a corresponding first direction along said guide tracks, a rotation of said shaft in an opposed second direction causing said carriage engaging means to move said carriage in a corresponding second direction along said guide tracks;

a drill assembly mounted to said carriage for movement therewith, said drill assembly having a drill motor and means for coupling a first drill rod to said drill motor for rotation in opposed directions;

means for coupling said thrust motor and said drill assembly to a source of pressurized hydraulic fluid for fluid communication therebetween;

a control panel mounted to said framework having user controls thereon, said control panel being operatively connected to said coupling means for selectably delivering said pressurized hydraulic fluid to said thrust motor and said drill assembly;

a clamping assembly including:

a housing mounted atop said front end wall and defining a bore for receiving said first drill rod therethrough;

a first clamp situated on said housing for selectably gripping and holding stationary said first drill rod such that said first drill rod is uncoupled from said drill motor coupling means when said drill motor is operated in a reverse direction; and a second clamp situated on said housing adjacent said first clamp for selectably gripping and holding stationary a second drill rod that is rotatably coupled to an end of said first drill rod such that said second drill rod is uncoupled from said first drill rod when said drill motor is operated in a reverse direction.

2. The apparatus as in claim 1 further comprising:

a plurality of spaced apart attachment flanges mounted to outward sides of said pair of guide tracks, each mounting flange defining a vertically extending tubular bore;

a plurality of stakes for selectively extending through said tubular bores of said plurality of mounting flanges, whereby to anchor said framework to a ground surface, each stake having a threaded portion; and a plurality of leveler nuts fixedly attached to lower ends of predetermined attachment flanges, each leveler nut having an internally threaded surface for engaging said threaded portion of a corresponding stake, whereby to selectively adjust a height of a corresponding portion of said framework.

* * * * *